United States Patent [19]

Mock

[11] 4,184,430

[45] Jan. 22, 1980

[54] METHOD AND APPARATUS FOR SEVERING TUBING

[75] Inventor: Wayne E. Mock, Arlington, Tex.

[73] Assignee: Jet Research Center, Inc., Arlington, Tex.

[21] Appl. No.: 811,424

[22] Filed: Jun. 29, 1977

[51] Int. Cl.[2] ..... F42B 3/00

[52] U.S. Cl. ..... 102/24 R; 102/24 HC; 102/DIG. 2; 166/297

[58] Field of Search ..... 102/20, 22, 23, 24 HC, 102/56 SC, 100, DIG. 2, 24 R; 166/297, 299

[56] References Cited

U.S. PATENT DOCUMENTS

| | | | |
|---|---|---|---|
| 1,758,358 | 5/1930 | Ennis | 102/100 |
| 2,775,940 | 1/1957 | Klotz, Jr. | 102/DIG. 2 |
| 2,921,519 | 1/1960 | Martin | 102/21.6 |
| 3,053,182 | 9/1962 | Christopher | 102/24 HC |
| 3,076,408 | 2/1963 | Poulter et al. | 102/23 |
| 3,100,445 | 8/1963 | Poulter | 102/24 HC |
| 3,118,374 | 1/1964 | Karpovich | 102/21.6 |
| 3,233,688 | 2/1966 | Bell | 102/24 HC |
| 3,664,262 | 5/1972 | Rose et al. | 102/24 HC |
| 3,782,283 | 1/1974 | Lingens | 102/67 |

FOREIGN PATENT DOCUMENTS

| | | | |
|---|---|---|---|
| 1359513 | 3/1964 | France | 102/24 HC |
| 796173 | 2/1958 | United Kingdom | 102/DIG. 2 |

*Primary Examiner*—Verlin R. Pendegrass
*Attorney, Agent, or Firm*—Thomas R. Weaver; J. H. Tregoning; C. Clark Dougherty, Jr.

[57] ABSTRACT

Apparatus for severing tubing along a generally transverse plane through the tubing wall, and including two confined explosive charges aligned axially with the tubing wall and terminating at opposed, proximal ends facing each other across a space disposed in such transverse plane. A portion of the opposed ends of the charges can contact each other, provided the main bodies of the two charges are spaced at the location of the plane of desired severance. Detonation devices are disposed at the distal or remote ends of the charges for originating detonation of the charges at such distal ends.

The apparatus is employed by emplacing the confined charges in the tubing to be severed with the charges positioned on opposite sides of, and terminating with their proximal ends substantially at, the plane in which the desired severance is to be effected. The charges are then simultaneously exploded by concurrently initiating the explosion of each at points substantially equidistantly spaced from the desired plane of severance.

30 Claims, 8 Drawing Figures

METHOD AND APPARATUS FOR SEVERING TUBING

This invention relates to explosive devices used for selectively severing metal or the like, and in a specific aspect, relates to a method and apparatus for explosively effecting the in situ cutting of drill collars at a selected downhole location.

In the drilling of oil and gas wells, the drill string sometimes becomes fouled and obstructed so as to become struck in the well bore several hundred feet below ground level. On occasion, attempts to free the drill string result in loss of substantial parts, or even possibly all, of the drill stem. In many such cases, it has been the practice, where the size and nature of the drilling rig permitted, to lower a suitable cutting tool into the drill string to the location where the fouling exists, and to there cut through or sever the drill string, preferably at a collar, in order to free at least the upper portion of the string. On some occasions, where the drill pipe is large in diameter, attempts to sever the string at a selected location have been carried out using an explosive charge. With relatively smaller diameter drill pipe, it has been found difficult to lower a sufficient amount of explosive to the locus of the fouling to effect disengagement of the free upper section of the string from the obstructed lower section. This is especially true when it is sought to sever the drill string by cutting through a drill collar, since these coupling elements in the string have a substantially greater wall thickness than the thickness of the drill pipe sections.

In some instances, the large amount of explosive required, and the relatively small diameter of the tubing, prevent the elongated cartridge or housing carrying the explosive from traversing bends or angulations in the tubing string of the sort which are frequently encountered in operational drilling. Even where larger amounts of explosive are susceptible to utilization, shock waves are frequently generated upon detonation which are of sufficient magnitude and are sufficiently widely dispersed that undesirable damage is caused to surrounding structure.

On other occasions during oil and gas well drilling, blow-outs can occur in which drilling fluid is lost at the location of the blow-out unless cementing can be effected at that location to alleviate the blow-out by plugging the well. At times, it is possible to perforate a drill collar at the location of the blow-out, and to squeeze a sufficient amount of cement through it to alleviate the blow-out. Sometimes, however, drill collar perforation in this manner does not permit a sufficient quantity of cement to be squeezed through the perforations and into the annulus to effectively overcome the blow-out. In such instances, it would be desirable to in some way sever or cut through the drill collar to a sufficient degree to permit an adequate quantity of cement to be forced through the collar at a high enough rate to permit the well to be plugged. The present invention is a method and apparatus for efficiently and selectively severing thick-walled tubing at a selected location. The tool used can be effectively placed in a pipe of relatively small inside diameter, and whether the pipe be straight, or curved and bent to some extent.

Broadly described, the tubing severing apparatus of the invention comprises a housing in which are contained a pair of explosive charges which are aligned along the axis of the housing. The housing is transversely dimensioned to facilitate its insertion in a pipe or tubing to be severed at a selected location. The explosive charges include adjacent, facing end portions toward the center of the surrounding housing, which end portions define between them an air gap or space. A small part of these end portions of the two charges can be in contact with each other, provided only that the air gap or space between the main bodies of the two charges is maintained. Preferably, the end portions of the two charges are of a generally convex conical configuration, and are in contact with each other at the apices of the cones. Means are provided for detonating the charges at the opposite ends thereof so that detonation waves are propagated axially within the housing and collide at the location of the adjacent, opposed ends of the two charges which define the air gap or space.

In utilizing the apparatus of the invention for severing a downhole drill string, the housing containing the explosive charges arranged in the manner described is placed upon the end of a suitable wire line carrying electrical conductors appropriate to effect detonation of the charges when a power source at the surface is activated. The apparatus is then lowered on the wire line to the desired depth within the drill string which is to be severed. Detonation of the two explosive charges at the distally disposed ends thereof, as they are located in opposite ends of the housing, is then simultaneously initiated.

An advantage of the tubing cutter apparatus of the invention is that a relatively small amount of explosive charge can be used to selectively sever or cut through relatively thick pipe or tubing at a precisely selected downhole location with total control being effected from the surface.

An object of the invention is to provide a compact drill collar cutting apparatus which can be easily lowered into a drill string without being blocked or obstructed by bends or departures from linearity occurring over the length of the drill string.

An additional object of the invention is to provide a tubing cutter apparatus which concentrates and selectively directs the force generated by the explosion of a relatively small amount of high explosive in such a way that a thick tubing, such as a drill collar, can be cleanly cut through at a selected location.

Another advantage of the invention is that the cutting apparatus of the invention concentrates and directs the force developed upon detonation of explosive charges in such manner that a thick drill collar may be cleanly cut through along a transverse plane without the force developed in the course of such cutting severely damaging or injuriously affecting an adjacent formation surrounding the bore hole.

In the drawings forming a part of this disclosure:

FIG. 1 is a schematic illustration of apparatus incorporating the concepts of the present invention;

FIG. 2*a* is a vertical sectional view taken along the axial center line of the lower portion of a downhole tool incorporating a drill collar cutter constructed in accordance with the present invention;

FIG. 2*b* is a vertical sectional view taken along the axial center line of the upper portion of the downhole tool illustrated in FIG. 2*a*, and constituting a vertical continuation of the structure shown in FIG. 2*a;*

Figure 1:
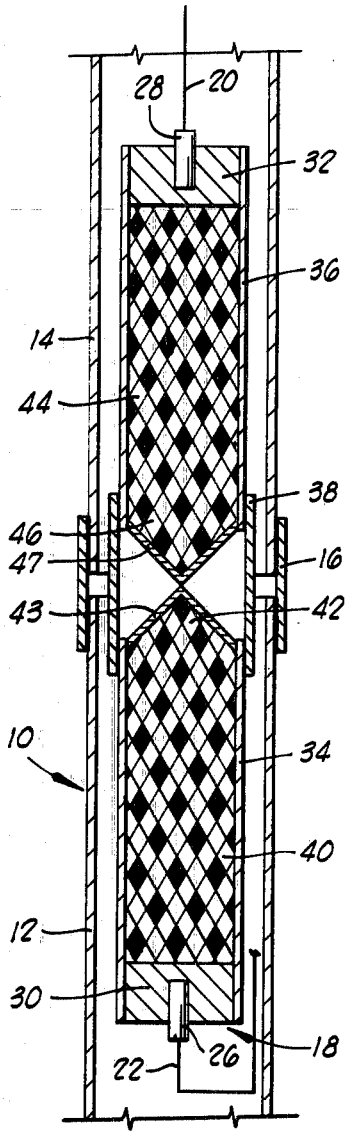

Referring initially to FIG. 1 of the drawings, the principal or basic concepts utilized in the construction of the apparatus and practice of the method of the invention are schematically illustrated. One of the most important applications and usages of the apparatus of the invention is in a downhole environment where it is desired to sever a drill string by explosively cutting through a drill collar. In FIG. 1, a drill string 10 includes drill pipe sections 12 and 14 interconnected by a relatively thick drill collar 16 in conventional array. The drill string is, of course, disposed in a bore hole (not shown). In most cases, the drill collar 16 is located at a substantial distance below the surface near the location where fouling of the string has occurred, or where it is desired to eject cement through a severed drill collar.

The drill collar cutter apparatus of the present invention is designated generally by reference numeral 18 and is placed in the selected downhole location by lowering the apparatus into the serially interconnected drill pipe sections on a wire line. In a preferred method of practicing the invention, the wire line utilized will include a cable head at its lower end to which the apparatus of the present invention can be attached, and will further include suitable electrical conductors for conducting an electrical current from the surface to the lower end of the wire line and through the cable head to certain electrically fired detonator devices forming a portion of a preferred embodiment of the drill collar cutter tool of the invention.

In FIG. 1, electrical conductors 20 and 22 are shown connected to a pair of detonator devices 26 and 28. The detonator devices 26 and 28 are mounted centrally within booster charges 30 and 32, respectively, which are placed within the respective distally disposed ends of a pair of axially spaced, cylindrically configured sleeves or housings 34 and 36. The housings 34 and 36 are interconnected in spaced, axial alignment by means of a connecting coupling 38 which telescopes over the proximate, facing ends of the housings. Alternatively, the housings 34 and 36 may be interconnected in a single or unitary cylindrical structure in which the cylindrical wall of the housing extends continuously between the locations of the booster charges 30 and 32, and the coupling 38 is eliminated.

Positioned within the housing 34 adjacent the booster charge 30, and filling a major portion of this housing, is a first main high explosive charge 40. The high explosive charge 40 terminates at its end which is adjacent the coupling 38 in a conically shaped end portion 42 which points toward the housing 36. A conical cap 43 of a rigid material can be placed over the end portion 42 of the charge. In similar fashion, a second main charge 44 of high explosive is positioned adjacent the booster charge 32 within the housing 36 and fills a major portion of this housing. The main explosive charge 44 terminates at its end adjacent the coupling 38 in a conically shaped end portion 46 located within a rigid conical cap 47 which preferably contacts the tip of the cap 43 over the end portion 42 of the main explosive charge 40.

It will be noted that the point of contact of the conical end portions 42 and 46 of the main charges 40 and 44 is immediately opposite and centrally disposed with respect to the coupling 38, and can be said to lie in a transverse plane extending through this coupling and through the concentrically positioned drill collar 16. Stated differently, the point of contact of the end portions 42 and 46 of the explosive charges 40 and 44 lies in a plane which projects normal to the axis of the drill string, as well as to the aligned axes of the housings 34 and 36.

In the operation of the schematically illustrated apparatus in carrying out the method of the invention, the apparatus 18 is emplaced by lowering it on the end of a wire line in the manner hereinbefore described, so that it is positioned opposite the drill collar 16 to be severed. The contacting conical ends 42 and 46 of the main explosive charges 40 and 44 thus are located in a transverse plane extending through the drill collar. With the apparatus in position, the detonator devices 26 and 28 are electrically actuated by closure of a suitable switch located at the surface to thereby close the electrical circuit to the detonators 26 and 28. Either DC or AC current may be utilized for detonation. Upon initiation of detonation, the booster charges 30 and 32 associated with the detonator devices 26 and 28, respectively, are caused to explode, and they in turn initiate explosion of the main charges 40 and 44. It will be perceived that the explosion of the main charges 40 and 44 is caused to be initiated or originated at their distally located or remote ends, or in any arrangement, at points located equidistantly from the respective conical ends 42 and 46.

As the main charges 40 and 44 explode, the detonation waves generated thereby collide at the locus of the cone-shaped end portions of the explosive charges, and there form an extremely high pressure zone around the cones in the middle section of the cutter apparatus. This high pressure is focused into a planar wave which acts perpendicular to the direction of propagation of the original detonation waves. The planar wave acting transversely across the apparatus exerts very high pressure which severs or blows away the coupling 38 and, upon impacting upon the interior of the drill collar 16, exerts a greater pressure on this element than the yield strength of the steel of which it is made. This action causes the drill collar to separate or be severed. The tubing severing apparatus of the invention is particularly useful and advantageous in its ability to cut through pipe or tubing having a wall thickness exceeding two inches, and to sever tubing characterized by an outside diameter to inside diameter ratio exceeding 2.

Figure 2A:
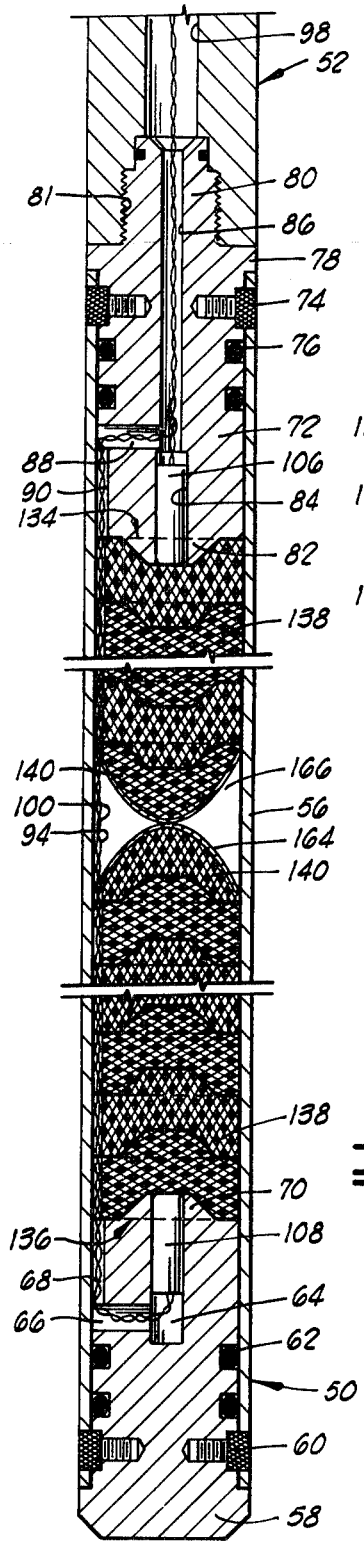
Figure 2B:
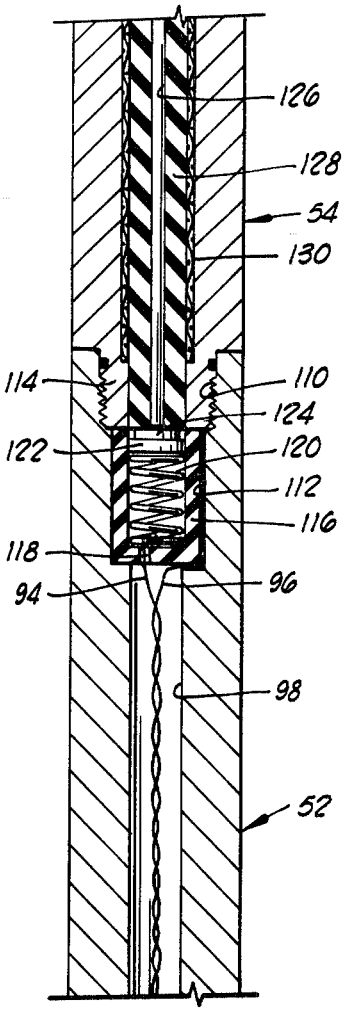

FIGS. 2*a* and 2*b* of the drawings illustrate in section a downhole tool which incorporates a preferred embodiment of a drill collar cutter constructed in accordance with the invention. The collar cutter per se is designated generally by reference numeral 50, and is illustrated in FIG. 2*a*. The upper portion of an adapter 52 and a wire line cable head 54 to which the adapter is connected are shown in FIG. 2*b*.

The drill collar cutter apparatus 50 includes an elongated cylindrical tubing 56. The lower end of the tubing 56 is closed by a bull plug 58 secured in the tubing by cap screws 60 and sealingly engaged therewith by means of O-rings 62. The bull plug 58 is provided with a central or axial cavity 64 which projects downwardly into the plug from the upper end thereof and communicates with a transverse passageway 66 which projects radially into the bull plug from the outer periphery thereof. A peripheral, axially extending groove 68 is formed along the outer side of the bull plug 58 parallel to the cavity 64, and projects from the upper side of the bull plug to a point of communication with the transverse passageway 66. The upper side of the bull plug 58 at which the central cavity 64 opens preferably includes a frusto-conical protuberance configured to mate with a frusto-conically shaped cavity formed in a high explosive cartridge hereinafter described.

At the upper end of the tube 56, the tube is closed by a mandril end plug 72. The mandril end plug 72 is retained in the tube 56 by cap screws 74, and is sealed against the tube by O-rings 76. A circumferential flange 78 is formed around the outer periphery of the upper end portion of the mandril end plug 72 and bears against the upper end of the tube 56. Above the flange 78, an externally threaded neck portion 80 of the plug 72 projects into and threadedly engages an internally threaded female box cavity or socket 81 in the lower end of the adapter 52.

The lower end of the mandril end plug 72 is a centrally located frusto-conical protuberance 82 which extends downwardly in the tube 56, and is substantially identical in configuration to the frusto-conical protuberance 70 at the upper end of the bull plug 58. An axial or central cavity 84 extends into the mandril end plug 72 from the apex or lowermost portion of the protuberance 82, and communicates with an elongated axial bore 86 which extends through the end plug from the upper end thereof. A transverse passageway 88 projects radially inwardly from one side of the plug 72 to intersect and communicate with the axial bore 86 at a location immediately above the axial cavity 84. The transverse passageway 88 registers with a relief or groove 90 formed in an axial direction along the outer periphery of the end plug 72, and terminating in the lower end face of the end plug.

Figure 7:
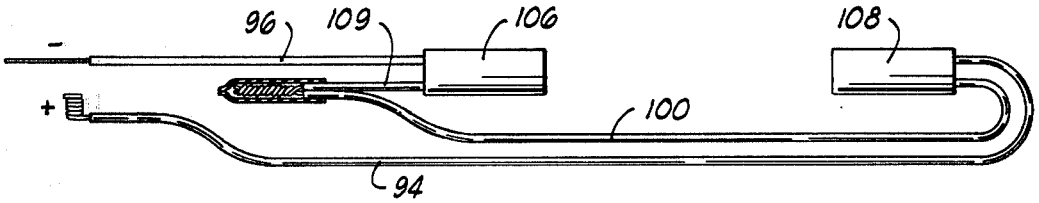
FIG. 7 is an electrical wiring diagram illustrating the manner in which the detonator elements used in the cutting apparatus are electrically interconnected.

For the purpose of initiating detonation of the high explosive charges used in the apparatus of the invention, a pair of electrical conductors 94 and 96 (see FIG. 2*b*) extend downwardly through an axial bore 98 in the adapter 52 and through the axial bore 86 in the end plug 72 to the intersection of the transverse passageway 88 with the axial bore 86. At this location, the conductor 94 and another electrical conductor 100 extend out through the transverse passageway and project downwardly through the groove 90 along the side of the tubing 56 to the lower end thereof. There the conductors 94 and 100 enter the groove 68 in the bull plug 58 and are then led through the transverse passageway 66 into the axial cavity 64 in the bull plug. The conductor 96 is connected at its lower end to a detonator element 106 which is positioned in the cavity 84 with its lower end flush with the lower end of the frusto-conical protuberance 82. In similar fashion, the lower ends of the conductors 94 and 100 are connected to a detonator element 108 which is positioned in the cavity 64 and has its upper end flush with the upper end of the frusto-conical protuberance 70 at the upper end of the bull plug 58. A short conductor 109 is connected between the detonator element 106 and the conductor 100 so that the detonator elements are wired in series, as shown in FIG. 7.

For the purpose of completing the electrical circuit necessary to electrical firing of the detonating elements 106 and 108, the conductors 94 and 96 are made part of an electrical circuit extending to the surface of the earth where a power source and switch are located for energizing and closing the circuit. Although the structure of apparatus facilitating the downhole extension of the conductors 94 and 96 is well understood in the art, this is accomplished in the illustrated embodiment of the invention by connection of the conductors in an appropriate fashion to the lower end of a cable head 54 suspended upon the lower end of a conventional wire line. The adapter 52 has an internally threaded female box 110 formed in the upper end thereof and communicating with the open upper end of an axial cavity 112 in the adapter. The cavity 112 in turn communicates with the axial bore 98 which extends downwardly in the adapter to the end plug 72. The box 110 threadedly receives an externally threaded pin 114 formed on the lower end of the cable head 54.

The lower end of the pin 114 abuts the upper end of a spring cup 116 which is constructed of a dielectric or electrically nonconductive material and is seated in the cavity 112. The conductor 96 is extended around the outer side of the spring cup 116 and is suitably grounded to the metallic wall of the adapter 52. A small opening 118 is formed in the bottom of the spring cup 116 and functions to permit extension into the interior of the spring cup of the conductor 94. Inside the spring cup 112, the insulation is removed from the end portion of the conductor 94, and the bare conductor is connected to a helical spring 120.

The spring 120 functions to resiliently urge or bias a contactor plate 122 upwardly into contact with a contact head 124 secured to the lower end of a flexible electrical conductor element 126 forming a part of the cable head 54. The conductor element 126 is enclosed within a tube 128 of an insulator material, and the tube is in turn enclosed in a braided shield 130 of conventional construction. The entire cable head 54 as thus constructed is of conventional construction and is attached to the lower end of a wire line (not shown).

The force required for severing a drill collar or other tubular member at a selected location when the drill collar surrounds the cutter apparatus 50 is developed by detonation of explosive charges positioned within the tube 56 between the bull plug 58 and the mandril end plug 72. For purposes of discussion, the explosive charges utilized will be referred to generally as an upper explosive charge 134 and a lower explosive charge 136. It should be pointed out that though portions of the two explosive charges and the surrounding tube 56 have been broken away and not shown in FIG. 2*a* in order to afford clarity of illustration, and sufficient compactness in the drawing, the upper and lower explosive charges 134 and 136 are preferably substantially identically shaped and sized so as to develop substantially equal explosive forces when they are fired.

Each of the explosive charges 134 and 136 consists of a plurality of truncated explosive cartridges 138, and a conical cartridge 140. The configuration of these respective high explosive cartridges is more clearly and specifically illustrated in FIGS. 3–6.

Figure 3:
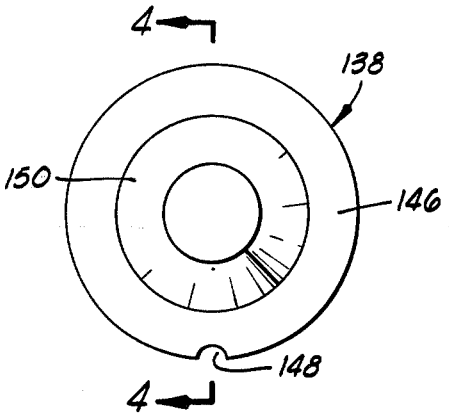
FIG. 3 is a plan view of a truncated cone explosive cartridge of the type used in the drill collar cutter device illustrated in FIGS. 2*a* and 2*b;*
Figure 4:
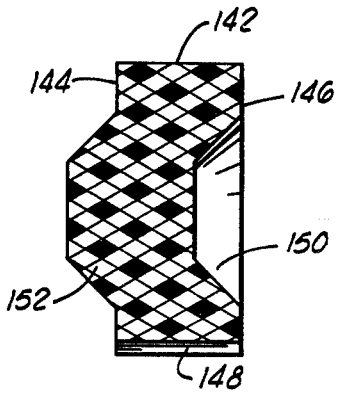
FIG. 4 is a sectional view taken along line 4—4 of FIG. 3.
Figure 5:
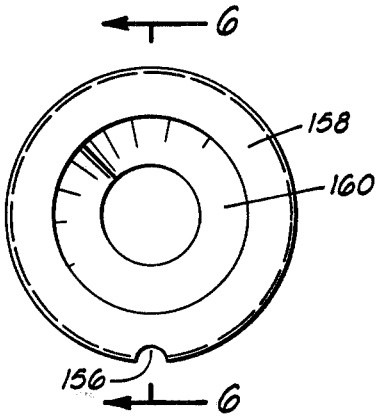
FIG. 5 is a plan view of a conical explosive cartridge of the type utilized in the drill collar cutter device illustrated in FIGS. 2*a* and 2*b;*
Figure 6:
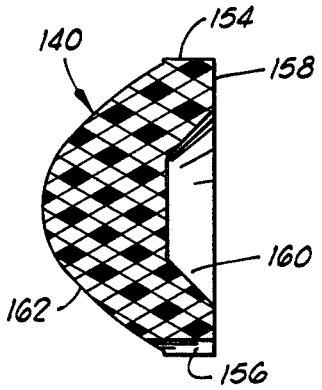
FIG. 6 is a sectional view taken along line 6—6 of FIG. 5.

It will be perceived in referring to FIGS. 3 and 4, which show one of the truncated cartridges 138, that this structure includes the body of a suitable high explosive material which is formed to have a generally cylindrical outer periphery 142 intersected by a pair of substantially parallel, axially spaced planar end faces 144 and 146. Extending between the end faces 144 and 146 at one side of the cartridge 138 is a peripheral groove 148 which extends parallel to the axis of the tube 56 and functions to pass the electrical conductors 94 and 100 as they are extended down one side of the tube for connection to the lower detonator element 108 (see FIG. 2a). A frusto-conical cavity 150 is formed in the planar end face 146 of each truncated cartridge 138, and a truncated protuberance or projection 152 complementary in configuration to the cavity 150 is formed upon and projects out of the planar end face 144. It will be perceived in referring to FIG. 2a that the described configuration of the truncated cartridges 138 permits them to be stacked in nesting relationship within the tube 56, with the lowermost cartridge in the lower high explosive charge 136 nestably receiving the complementary frusto-conical projection 70 at the upper end of the bull plug 58, and the uppermost cartridge in the upper high explosive charge 134 nestably receiving the downwardly projecting complementary frusto-conical protuberance 82 formed on the lower end of the mandril end plug 72.

At the proximate or centrally disposed ends of the upper and lower high explosive charges 134 and 136, respectively, each of these charges includes a conical explosive cartridge 140. The appearance of each of the conical cartridges 140 is illustrated in detail in FIGS. 5 and 6. Each of the conical cartridges 140 is characterized in having a cylindrical outer peripheral surface 154 which is grooved along one side by a peripheral groove 156 extending parallel to the axis of the tube 56. The groove 156 projects from a planar end face 158 defining a frusto-conical cavity 160 to a generally conical face 162 on the opposite side of the cartridge from the end face 158. The face 162 of the conical cartridge 140 is preferably of parabolic cross-sectional configuration.

It will be noted in referring to FIG. 2a that the conical cartridges 140 carried at the lower end of the upper high explosive charge 134 and the upper end of the lower high explosive charge 136 face each other with the apices of the conical surfaces 162 in immediate proximity to each other. In a preferred construction of the invention, a hollow metallic cap 164 is positioned over the respective parabolically configured surfaces 162 of the conical cartridges 140, and the metallic caps contact each other at a point which lies in the axis of the tube 56. The caps 164 are preferably constructed of thin copper plate. It will be perceived that the described arrangement of the high explosive charges in the upper charge 134 and lower charge 136 is such that an air space or gap 166 exists between the main bodies of both these high explosive charges, and is that air space which surrounds the parabolically shaped generally conical surfaces 162 at the facing sides of the conical cartridges 140.

The types of high explosive material used in the charges 134 and 136, and specifically in both the truncated cartridges 138 and the conical cartridges 140, can vary widely. Examples of suitable high explosives are those described in U.S. Pat. No. 3,865,436 to Dorrough and Brown issued February 11, 1975. The explosives RDX (Cyclotrimethylenetrinitramine, Hexahydro-1, 3, 5-Trinitro-5-Triazine, Cyclonite, Hexogen, T4) and COMP B (Cyclotol) are preferred.

In typical construction of the drill collar cutter apparatus 50, the tube or housing in which the explosives are located will have an outside diameter of from 1½ inches up to about 2½ inches. The overall length of the explosive used will be from about 10 inches to about 20 inches, such dimensions depending, of course, upon the drill pipe diameter and the drill collar thickness.

In the operation of the drill collar cutting apparatus illustrated in FIGS. 2–6, a switch is closed at the surface to complete the electrical circuit extending downhole through the wire line cable head 54 and adapter 52 to the detonator elements 106 and 108. As previously indicated, either alternating or direct current can be used to electrically fire the detonator elements. When the detonator elements 106 and 108 are exploded, detonation of the high explosive charges 134 and 136 is simultaneously commenced. As the explosion of these charges proceeds, detonation waves are developed and propagated toward the center of the tube 56, and these waves converge and collide at the location where the metallic caps 164 capping the conical cartridges 140 are in contact. A zone of extremely high pressure is developed at this location and is focused into a planar shock wave acting perpendicular to the direction of propagation of the colliding original detonation waves. A tremendous pressure is developed within the tubing 56 at this location, and acts transversely of the tubing and perpendicular to the axis thereof. This pressure quickly ruptures the tube 56 and impinges upon the internal wall of a surrounding drill collar in the manner previously described. The pressure is of sufficient magnitude that it exceeds the yield strength of the steel drill collar and severance of the drill collar is thereby effected.

Although a preferred embodiment of the invention has been herein described in order to provide exemplary illustration of the basic principles which underlie the invention, it will be understood that various changes and innovations in the depicted and described structure can be effected without departure from the basic principles which underlie the invention. Changes and innovations of this type are therefore deemed to be circumscribed by the spirit and scope of the invention, except as the same may be necessarily limited by the appended claims or reasonable equivalents thereof.

What is claimed is:

1. A drill collar cutter apparatus for severing a drill collar in a downhole environment consisting essentially of:

an elongated tubular housing;

lowering means connected to one end of said housing for lowering said housing in a drill string;

first explosive charge means in said housing said first explosive charge means having a first end and a generally convex second end;

second explosive charge means in said housing in axial alignment with said first explosive charge means said second explosive charge means having a first end and a generally convex second end said first and said second explosive charge means being positioned within said tubular housing means such that the generally convex second ends of said first and said second explosive charge means are in adjacent opposed relationship and said generally convex second ends cooperate to define and maintain an *explosive-free* open space between said first and said second explosive charge means;

a first detonator element at said first end of said first charge means; and a second detonator element at said first end of said second explosive charge means.

2. A drill collar cutter apparatus as defined in claim 1 wherein the second end of each of said explosive charge means comprises a metallic cap having a convex surface with the convex surfaces of the caps contacting each other to further define said explosive-free space around the locus of contact within said tubular housing.

3. A drill collar cutter apparatus as defined in claim 2 wherein said lowering means comprises a wire line.

4. A drill collar cutter apparatus as defined in claim 2 and further characterized as including electrical circuitry connected to said detonator elements for electrically firing the detonator elements and comprising electrical conductors extending through said lowering means for powering and controlling the circuitry from the surface.

5. A drill collar cutter apparatus as defined in claim 4 wherein each of said first and second charges comprises:

a conically configured explosive cartridge having its apex comprising said convex second end of the respective charge.

6. A drill collar cutter apparatus as defined in claim 5 wherein each of said first and second charges comprises:

a plurality of nestable explosive cartridges stacked axially in said tubular housing in internested array and including one nestable cartridge in contact with the base of the conically configured cartridge; wherein each of said nestable cartridges comprises a body of explosive having a cylindrical outer peripheral surface mated to the inside diameter of said tubular housing;

a pair of spaced, parallel planar end surfaces intersecting the peripheral surface;

a cavity extending into one of said end surfaces; and a protuberance complementary in configuration to said cavity and projecting from the other of said end surfaces for registering engagement with the cavity of an adjacent nestable cartridge.

7. A drill collar cutter apparatus as defined in claim 6 wherein each of said conically configured cartridges includes:

a parabolic surface comprising the convex second end of one of said charges; and a surface defining a cavity on the opposite side of the respective conically configured cartridge from said parabolic surface.

8. A drill collar cutter apparatus as defined in claim 6 and further characterized as including plugs closing opposite ends of said tubular housing and each including a projection extending into, and mating with, the cavity in an adjacent one of said nestable cartridges, said plugs each defining a cavity extending axially in said tubular housing and receiving one of said detonator elements.

9. A drill collar cutter apparatus as defined in claim 6 wherein each of said first and second explosive charge means defines groove means adjacent said tubular housing and extending parallel to the axis thereof for receiving said electrical conductors extended from said lowering means to one of said detonator elements.

10. A drill collar cutter apparatus as defined in claim 6 wherein each of said cartridges is peripherally grooved, and said cartridge grooves define with said housing a conductor passageway for receiving electrical conductors extended from said lowering means to one of said detonator elements.

11. Tubing cutting apparatus consisting essentially of a tubular housing having an upper end and a lower end;

a first explosive charge confined in the upper portion of the housing and terminating in a convex end portion adjacent the center of the housing;

a second explosive charge confined in the lower portion of the housing and terminating in a convex end portion adjacent the center of the housing;

an explosive-free space at the center of the housing adjacent the convex ends of the first and second charges; and means for detonating both of the explosive charges at locations spaced axially in the housing from the center thereof.

12. The method of severing a tubular member along a plane extending normal to the axis thereof consisting essentially of configuring two explosive charges as elongate bodies terminating in protuberant, convexly shaped end portions;

confining the two charges in an enclosing, elongate housing sized for insertion in the tubular member with the elongate bodies in longitudinal alignment, and with the convexly shaped end portions in adjacent opposed relationship wherein said convexly shaped end portions cooperate to define and maintain an open space between said charges within said housing;

positioning the housing inside the tubular member with the convexly shaped end portions substantially in the desired plane of severance of the tubular member; and simultaneously detonating the charges by initiating the explosion thereof at points therealong substantially equidistant from the convexly shaped end portions.

13. The method of claim 12 wherein said convexly shaped end portions are in tangential contact with each other.

14. The method defined in claim 13 wherein in configuring said explosive charges, each body is assembled by nesting a plurality of separate explosive cartridges in a stack with adjacent cartridges having registering protuberances and cavities.

15. Apparatus for severing a tube along a plane extending generally transversely through the walls of said tube, said apparatus consisting essentially of:

two explosive charges each of said charges having a distal end and a proximal end;

two detonation means for simultaneously initiating detonation of said charges at said distal ends thereof; and housing means for confining and aligning said two charges within the interior of said tube; wherein said two charges are axially positioned within said housing means such that said proximal ends are effectively placed in adjacent opposed relationship and cooperate to define and maintain an explosive-free air space between said charges within said housing means and said distal ends are spaced axially in said housing means from said air space; and wherein one of said detonation means is positioned at each said distal end so that upon initiation detonation waves propagate axially through each of said charges within said housing means to collide at said air space and sever the walls of said tube along a plane extending generally transversely through said air space and said walls.

16. The apparatus of claim 15 wherein each of said charges defines an electrical conductor-receiving passageway with said housing; and said detonation means comprises detonator elements contacting the respective distal ends of the respective charges; and an electrical circuit including electrical conductors extending through said passageways and connected to said detonator elements.

17. The apparatus of claim 15 wherein said detonation means comprises a pair of electrically actuatable detonator elements.

18. The apparatus of claim 15 being further comprised of means connected to said housing to facilitate gravity emplacement of said housing within said tube.

19. The apparatus of claim 15 wherein at least one of said charges comprises a plurality of stacked, internested explosive cartridges.

20. The apparatus of claim 15 wherein said proximal ends of said charges are in contact at a point along the longitudinal axis of said housing.

21. The apparatus of claim 20 wherein each of said proximal ends of said charges is parabolically configured.

22. The apparatus of claim 21 wherein at least one of said charges comprises a plurality of stacked, internested explosive cartridges.

23. The apparatus of claim 20 wherein each of said charges includes a plurality of internested explosive cartridges serially stacked; and a conical explosive cartridge in contact with one of said internested cartridges and having a parabolic face forming one of said proximal ends.

24. The apparatus of claim 23 being further comprised of a metal cap registering with said parabolic face and having a complementary parabolic configuration thereto.

25. Apparatus for severing thick-walled tubing from a location within the interior of said tubing, said apparatus consisting essentially of:

an elongated housing transversely dimensioned to facilitate insertion of said housing into the interior of said tubing;

two explosive charges confined and axially aligned within said housing each of said charges having a distal end and a proximal end, and positioned within said housing such that said proximal ends are effectively placed in adjacent opposed relationship and cooperate to define and maintain an explosive-free air space between said charges within said housing and said distal ends are spaced axially in said housing from said air space;

two caps each said cap covering one of said proximal ends and having a configuration complimentary to said proximal end; and two detonation means each said detonation means positioned at each said distal end for simultaneously initiating detonation of said charges at said distal ends thereof so that detonation waves propagate axially through each of said charges within said housing means to collide at said air space and sever the walls of said tubing along a plane extending generally transversely through said air space and said walls.

26. The apparatus of claim 25 wherein said proximal ends are convex and said caps are convex.

27. The apparatus of claim 26 wherein the apices of said caps are in contact.

28. The apparatus of claim 27 wherein said detonation means comprises a pair of electrically actuatable detonator elements, each of said elements contacting one of said distal ends.

29. The apparatus of claim 28 further comprising means connected to said housing to facilitate gravity emplacement of said housing within the interior of said tubing.

30. The apparatus of claim 29 wherein said tubing is a drill string.

* * * * *

UNITED STATES PATENT AND TRADEMARK OFFICE

CERTIFICATE OF CORRECTION

PATENT NO. : 4,184,430

DATED : January 22, 1980

INVENTOR(S) : Wayne E. Mock

It is certified that error appears in the above-identified patent and that said Letters Patent are hereby corrected as shown below:

In Column 1, at line 12, delete [struck] and insert therefor --stuck--.

In Claim 5, line 1, delete [4] and insert therefor --2--.

Signed and Sealed this

*Sixth* Day of *May 1980*

[SEAL]

*Attest:*

SIDNEY A. DIAMOND

*Attesting Officer*

*Commissioner of Patents and Trademarks*